United States Patent [19]

Voynovich

[11] 4,356,839

[45] Nov. 2, 1982

[54] TAMPER RESISTANT VALVE ACTUATOR FOR FIRE HYDRANT

[76] Inventor: Anthony Voynovich, 34-15 34th St., Astoria, N.Y. 11106

[21] Appl. No.: 301,461

[22] Filed: Sep. 14, 1981

[51] Int. Cl.[3] ..... F16K 35/06; E03B 9/06

[52] U.S. Cl. ..... 137/296; 81/90 C; 81/90 B; 137/382.5; 137/800; 220/85 P

[58] Field of Search ..... 137/296, 371, 377, 381, 137/382, 382.5, 800; 81/90 B, 90 C; 220/85 P, 284, 285, 286

[56] References Cited

U.S. PATENT DOCUMENTS

| | | | |
|---|---|---|---|
| Re. 27,616 | 4/1973 | Diaz | 137/382.5 |
| 1,856,492 | 5/1932 | Marshall | 137/382 |
| 2,442,920 | 6/1948 | De Vries | 81/90 C |
| 2,991,676 | 7/1961 | Bond | 81/90 B |
| 3,222,976 | 12/1965 | Holman | 81/90 B |
| 3,450,148 | 6/1969 | Mongelluzzo et al. | 137/296 |
| 3,453,897 | 7/1969 | Adinolfi | 137/296 |
| 3,626,961 | 12/1971 | Quinones | 137/296 |
| 3,709,249 | 1/1973 | Diaz | 137/296 |
| 3,929,152 | 12/1975 | Graham | 137/296 |
| 4,033,372 | 7/1977 | Bowman | 137/296 |

*Primary Examiner*—George L. Walton
*Attorney, Agent, or Firm*—Natter & Natter

[57] ABSTRACT

A tamper resistant valve actuator for a fire hydrant has a bullet shaped nose presenting a nongrippable conical surface. Three equally spaced shallow recesses are provided in the conical surface at a common elevation. A special wrench includes radially projecting set screws adapted for complementary fit within the recesses and adjustable tightening thereto for operating the valve stem. The actuator is designed for installation on conventional hydrant assemblies and in substitution of the existing pentagon head operating nut. In a modified embodiment, the valve operating nut is provided with a valve stem socket for compatibility with another form of hydrant assembly. In addition, the wrench receiving recesses are placed in a variant pattern.

14 Claims, 14 Drawing Figures

FIG. 3
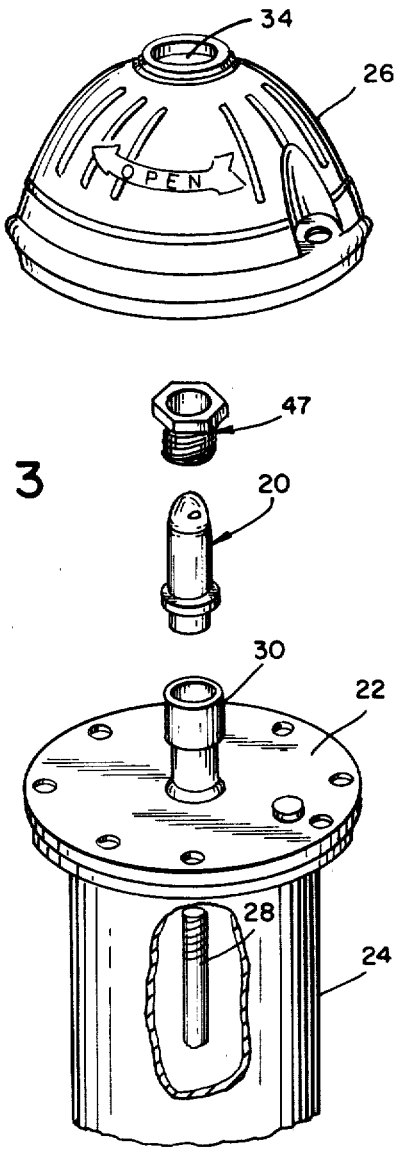
FIG. 5
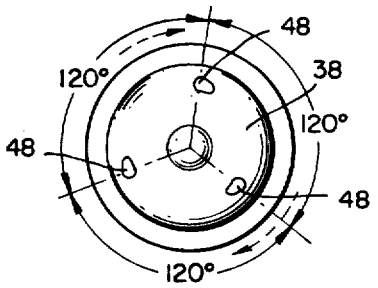
FIG. 11
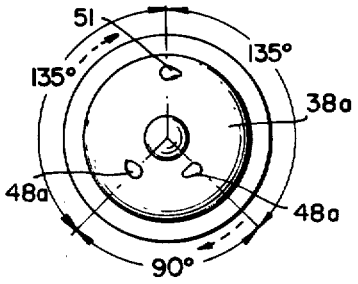
FIG. 6
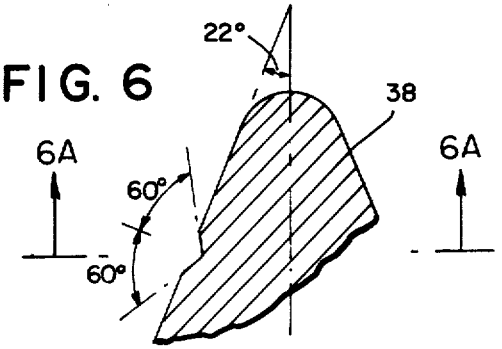
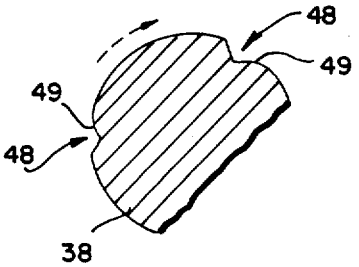
FIG. 6A

TAMPER RESISTANT VALVE ACTUATOR FOR FIRE HYDRANT

BACKGROUND OF THE INVENTION

1. Field of the Invention

This invention relates to a valve actuator and particularly to an improved actuator for preventing unauthorized operation of a fire hydrant.

The device of this invention especially concerns a tamper resistant valve operating nut and companion wrench.

2. Description of the Prior Art

The conversion of water resources has become an ever increasing problem especially during periods of short rainfall and in summer months. Aside from maintaining sufficient water supplies necessary and essential for industrial and personal consumption, fire protection in most municipalities is almost exclusively dependent upon the ability to meet required water demands. Most commonly, this is accomplished through a water distribution network which feeds fire hydrants with required demand flow over and above maximum normal consumption. Although the hydraulic design of these systems usually takes into consideration fluctuations in pressure or head loss, these systems cannot adequately compensate for excessive use of fire hydrants for nonauthorized purposes and the wanton and wasteful water consumption resulting therefrom. This operation of fire hydrants for mischievous or personal purposes presents a serious and frequent problem to many water and fire departments.

A typical double nozzle hydrant such as manufactured by Smith Manufacturing Co. utilizes a valve operating stem which extends through a standpipe and is accessible by an operating nut or yoke stem nut projecting above a bonnet. The operating nut conventionally is in a pentagon shape. In addition, the standard double nozzle hydrant has a nozzle and a steamer nozzle in the standpipe, each of which is sealed with a cap having the same dimensional pentagon shaped nut for operation. This structural arrangement facilitates opening and closing by fire department or other authorized personnel and allows use of a uniform size wrench. Unfortunately, the pentagon nut can also be operated by other tools such as by common pipe wrenches, pliers, hammer and chisel and other grasping tools or clamping apparatus.

Several devices were developed in an attempt to deter unauthorized hydrant usage. Some of those devices were directed at preventing removal of the nozzle outlet caps. One such device was a harness comprised of two arcuate bands of steel which had an opening at the respective ends adapted for engaging each of two discharge outlet cap nuts. The arms were bolted together at their opposite ends. That device, however, proved unsuccessful since the bolt connection could be readily severed and thus did not provide an effective deterrent.

Another fire hydrant discharge cap had two engaging surfaces for coacting with a special tool for unthreading the cap as was shown in U.S. Pat. No. 3,929,152. That device could similarly be defeated, as by wedging a sharp instrument between the interface of the cap and nozzle, which could thus loosen the threaded connection.

Another approach was directed to the encasement or covering of the pentagon shaped operating nut such as shown in U.S. Pat. Nos. 3,935,877 and 4,033,372. The devices shown in those last mentioned patents required the installation of rather cumbersome, expensive and elaborate apparatus. A major disadvantage of those devices was that they were subject to jamming and their reliability was questionable, especially under emergency use or for firefighting situations. Furthermore, the rather large diameter dome shown in the last mentioned patent provided a gripping surface for a strap which could be wrapped around the dome for frictional engagement and the valve could thus be operated. The locking system shown in the earlier patent could likewise be compromised with conventional tools.

The concept of developing a nut with a nongripping surface was also utilized in other applications such as shown by the cone shaped nut cover in U.S. Pat. No. 3,222,976, however the exposed Allen-head screws provided a method for readily removing this cone shaped cover. Another arrangement for a theft resistant nut apparatus was shown in U.S. Pat. No. 3,930,428, however the index facet arrangement has distinct shortcomings and that device was not resistant to conventional wrenches or other clamping tools.

It should also be noted that with regard to the application of the special operating wrench of this invention, U.S. Pat. No. 2,442,920 disclosed a tool for the removal of watch cases. The wrench of this invention, however, improves upon that concept for heavy duty operation and further utilizes two fixed position set screws or studs and a variably adjustable stud having a knurled handle. Furthermore, the central opening in the present invention is tapered in conformity with the conical surface of the operating nut and is also designed to provide marginal clearance space for locating the stud receiving recesses.

Another advantage of the instant invention is that it utilizes an operating nut fabricated of case hardened steel having a smooth concial surface providing an optimum angular orientation so as to prevent conventional wrenches or other tools from gripping and turning the nut. It should thus be evident that this device achieves a relatively foolproof locking system which is substantially nonjamming and relatively easy to operate.

A further advantage of this invention over the prior art is that the improved operating nut is completely compatible for use with standard hydrant assemblies and can be substituted for the corresponding pentagon stem nut.

In view of the foregoing, it should be apparent that the present invention overcomes many of the shortcomings of the prior art devices and provides an improved tamper resistant valve actuator for a fire hydrant which eliminates many of the problems of the prior art.

SUMMARY OF THE INVENTION

Briefly, the nature of this invention relates to an improved valve operating nut and special wrench with particular application to a fire hydrant.

The purpose of this invention is to provide a tamper resistant valve actuator for a fire hydrant which will effectively deter unauthorized use of the hydrant.

The substance of this device concerns a bullet nosed cylindrical nut adapted to replace an operating stem nut within a conventional hydrant assembly. The bullet nose portion is intended to project above the hydrant bonnet to provide accessibility for the special wrench. This exposed conical surface cannot be gripped for turning the nut except by using the customized wrench of this invention.

For accomplishing this gripping interaction between the specialized wrench and bullet nosed portion of the nut, a plurality of shallow recesses or notches are formed within the smooth conical surface. The wrench is provided with an annular frame member with a central opening having projecting studs corresponding to the location of the aforementioned recesses. One of the studs is adjustably tightenable for firmly securing the wrench to the conical surface.

In one form of the invention, the recesses are located at a common level and positioned at 120° displacement around the margin of the conical surface. In an alternate embodiment, two of the recesses are positioned at one elevation, while the third recess is located at a different elevation. In addition, the two recesses located at the same elevation are positioned 90° from each other, whereas the third recess is positioned 135° respectively from each of the first mentioned recesses. This variant arrangement provides increased protection against attempts to duplicate the special wrench.

A feature of the recesses includes a curved slip surface which converges with the conical nose surface and substantially eliminates a leverage point for driving a punch or like instrument.

The design of the operating nut, aside from the bullet nosed portion, can be modified in accordance with the specifications of fire hydrants sold by various manufacturers, e.g. Mueller, American Darling. One such modification for use with the Dresser type hydrant is illustrated herein.

Having thus summarized the invention, it will be seen that an object thereof is to provide a tamper resistant valve actuator for a fire hydrant of the general character described herein which is not subject to the aforementioned disadvantages.

Specifically, it is an object of this invention to provide a tamper resistant valve actuator for a fire hydrant utilizing a bullet nosed operating nut which can be operated only by a specialized wrench of this invention.

A further object of this invention is to provide a tamper resistant valve actuator for a fire hydrant which is compatible with existing fire hydrants and can be substituted as a replacement part.

An additional object of the present invention is to provide a tamper resistant valve actuator which is durable in construction and provides a minimal exposed conical surface which is highly resistant to tampering and destructive attack.

Yet another object of this invention is to provide a tamper resistant valve actuator for a fire hydrant which is simple in construction, low in cost, reliable in use and well adapted for mass production fabrication techniques.

Other objects of the invention in part will be apparent and in part will be pointed out hereinafter.

With these ends in view, the invention finds embodiment in certain combinations of elements and arrangements of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which are shown possible exemplary embodiments of the invention:

FIG. 3 is an exploded view of the fire hydrant assembly showing the relationship of the various elements including the valve actuator of this invention;

FIG. 5 is a top plane view of the nose portion showing the angular orientation of the shallow recesses and the conical surface;

FIG. 6 is a partial sectional view taken substantially along line 6—6 of FIG. 4 detailing the angular inclination of the conical surface and the shallow wrench engaging recess;

FIG. 6A is a partial sectional view taken substantially along line 6A—6A of FIG. 6 further illustrating the wrench engaging recess and a curved slip surface;

FIG. 11 is a top plane view of the modified valve actuator shown in FIG. 10 indicating the angular displacement between the shallow recesses;

DESCRIPTION OF THE PREFERRED EMBODIMENTS

Figure 1:
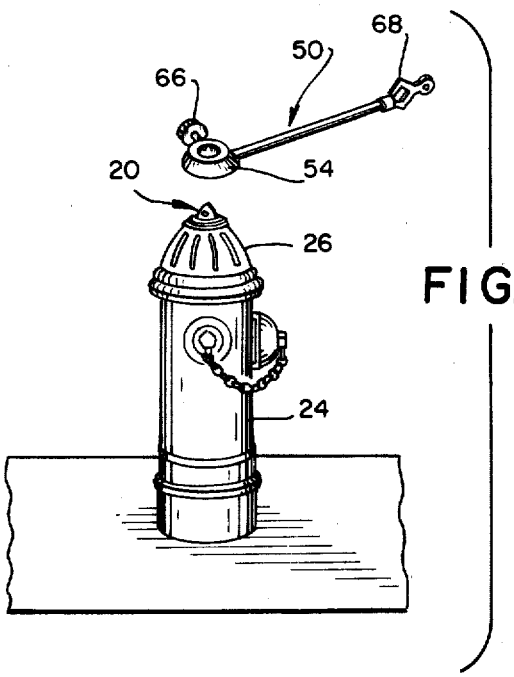
FIG. 1 is a perspective view of a typical fire hydrant showing a tamper resistant valve actuator and special wrench of this invention.

Referring now in detail to the drawings, the reference numeral 20 denotes generally a tamper resistant valve actuator and a special wrench 50 in accordance with this invention. The valve actuator 20 is illustrated in FIG. 1 in a typical fire hydrant installation. It should be noted, however, that the valve actuator 20 and the special wrench 50 are adaptable for use within the purview of this invention in substitution of any operating nut found on fire hydrant nozzle caps or on other apparatus wherein it is advantageous to provide a tamper resistant nut.

Figure 2:
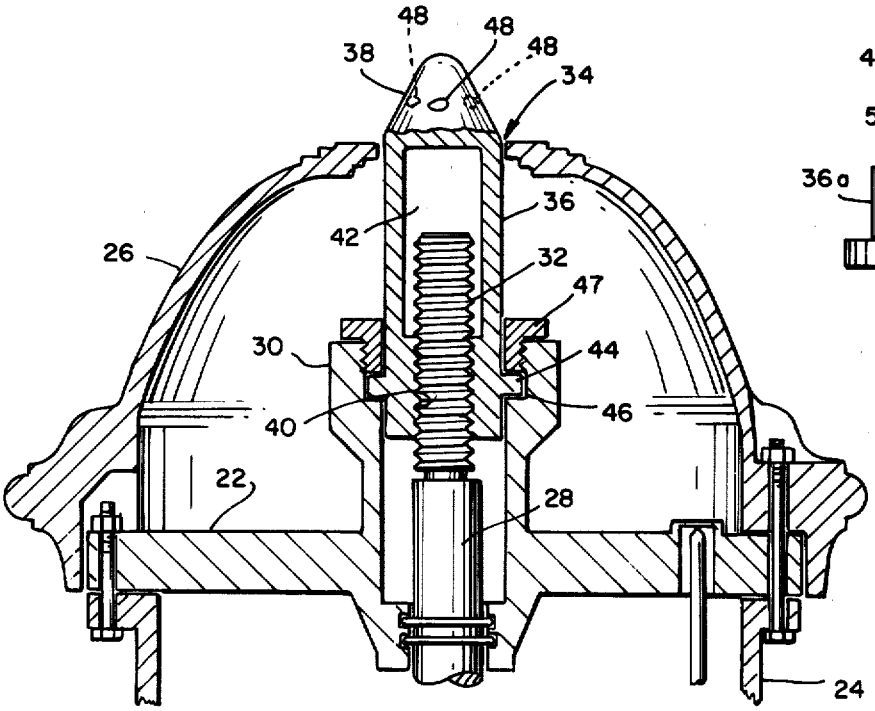
FIG. 2 is a sectional view to an enlarged scale of the upper portion of a fire hydrant assembly illustrating the valve actuator as installed therein.
Figure 10:
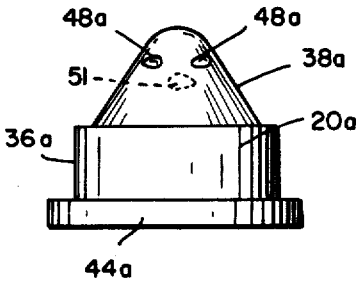
FIG. 10 is an elevational view of a modified form of the valve actuator of this invention showing the shallow recesses positioned in a variant pattern.

With regard to this exemplary embodiment, FIGS. 2 and 3 show a hydrant assembly including a seal plate 22 bolt mounted over a standpipe 24 and having a bonnet 26 enclosure. A vertically mounted valve stem 28 extends through the seal plate 22 and a yoke member 30. The valve stem 28 has at its upper terminal an externally threaded stem extension 32. The valve actuator 20 is coupled to the threaded stem extension 32 as will be described hereinafter. Conventionally, a yoke stem nut (not shown) is threaded to the stem extension 32 and projects through an aperture 34 at the top of the bonnet 26. The projecting portion of the yoke stem nut is conventionally provided with a standard pentagonal head.

Figure 4:
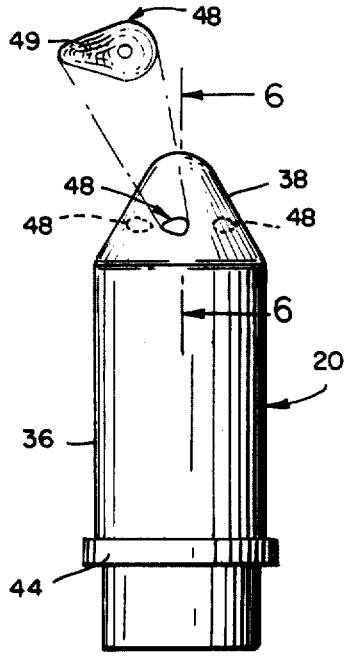
FIG. 4 is a front elevational view of the valve actuator showing a cylindrical body and conical nose portion including three wrench engaging shallow recesses, with one of said recesses being shown also in an enlarged projection for clarity.

The improved valve actuator 20, as shown in FIG. 4, has a cylindrical body portion 36 and a conically tapered end forming a bullet shaped nose 38. The distal end is provided with an internally threaded bore 40 approximately 1½" in depth having a 15/16" internal diameter of 6 threads per inch of standard lefthand thread. In addition, a hollow core 42 approximately 1⅛" in diameter and 2⅛" in height is provided for receiving the threaded stem extension 32. The overall length of the actuator 20 is approximately 4-1/16" and the outside diameter is 1-17/32".

A shoulder portion 44 is also provided along the cylindrical body portion 36 for positionally seating the valve actuator 20 upon a circular ledge 46 formed within the yoke 30. A hold-down nut 47 secures the actuator 20 within the yoke member 30.

The bullet shaped nose portion 38 is substantially a conical section approximately 1-1/6" in height having a rounded apex. The angular inclination of the conical surface with respect to a vertical axis of the cone is within the range of 15°-35° and preferably 22° (see FIG. 6).

It has been found that an inclination angle within this range provides a favorable nongrippable surface which cannot be clampingly engaged by conventional wrenches or other tools because this angular orientation does not present a sufficient surface area for the tool to obtain a significant bite. Furthermore, the valve actuator 20 is fabricated of a case hardened steel to make same impervious to an impact blow by a cold chisel, punch, drill bit or similar instrument.

A plurality of cone shaped indentations or recesses 48 have been provided in the bullet shaped nose 38 during fabrication. The recesses 48 are of uniform size and depth and are at a common level so as to lie within the same horizontal plane. In a preferred embodiment, each of the recesses 48 is teardrop shaped and at its deepest point penetrates approximately 5/64" below the conical surface. This area of the recess has a 180° circumference and a diameter of about 5/16". The wall of the semi-circular perimeter forms an included angle of approximately 60° with a perpendicular passing through the circle as shown in FIG. 6. The remaining wall perimeter is gradually curved to coverage with the conical surface of the nose, as noted in FIG. 6A, to form an included angle greater than 120° and to provide a slip surface 49 being effective for defeating a chisel, spanner wrench, etc., for operating the valve actuator 20. It should be further observed that the slip surface 49 corresponds with the direction of rotation (see broken arrow in FIG. 6A) for opening the hydrant valve.

Figure 8:
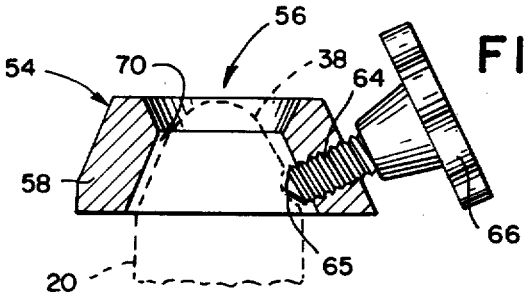
FIG. 8 is a sectional view taken substantially along line 8—8 of FIG. 7 illustrating the conical surface of the valve actuator in broken line and an adjustably tightenable set screw for securing the special wrench to the actuator.
Figure 9:
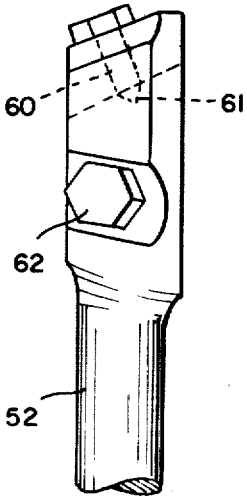
FIG. 9 is a partial elevational view of the special wrench showing the angular orientation of the set screws.
Figure 13:
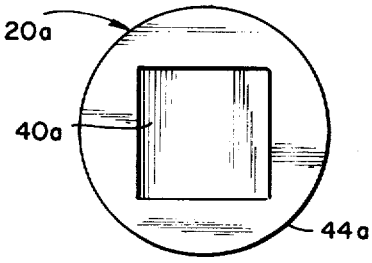
FIG. 13 is an auxiliary view taken substantially along line 13—13 of FIG. 12 and detailing the socket coupling provided for receiving the hydrant valve stem.

It is contemplated that a companion wrench 50 will be used for operating the valve actuator 20. The wrench 50 has an elongated handle 52 for providing leverage and terminates in an annular frame 54. The frame member 54 defines a central opening 56 having a tapered side wall 58 corresponding to the angular inclination of the bullet shaped nose 38. The annular frame 58 is further provided with internally threaded radial apertures for receiving threaded studs or set screws 60,62, 64. The set screws are preferably of case harden steel having a diameter of approximately ⅜". The set screws 60, 62 have standard hexagonal heads for securement and a cone point 61, 63 respectively, corresponding to the circular perimeter of the recesses 48. The set screw 64 is similar to the aforementioned screws having a cone point 65, however a knurled handle 66 has been provided to permit adjustable tightening when the cone points 61, 63, 65 are received within the deepest portion of the recesses 48 to grippingly engage the bullet shaped nose 38 as illustrated in FIG. 8. The valve actuator 20 can then be rotated either clockwise or counterclockwise upon application of a horizontal force to the handle 52.

It should also be noted that the distal end of the handle 52 includes a pentagon head 68 as shown in FIG. 1 for operating the standard pentagonal nuts on the nozzle caps.

An alternate embodiment of the invention will now be described with reference to FIGS. 10—13 wherein the same reference numeral has been used for designating corresponding elements in the previous embodiment, however with the suffix "a" being added.

An alternate valve actuator 20*a* has a stub cylindrical body portion 36*a* and an integrally formed conically shaped bullet nose 38*a* having a rounded apex. The base of the cylindrical body 36 has an annular shoulder 44*a* and further includes a rectangular recessed socket 40*a*.

The nose portion 38*a* includes two shallow depth recesses or indentations 48*a* located at a common level or lying within the same horizontal plane. A third shallow depth recess or indentation 51 has been provided at a different elevation. Furthermore, the recesses 48*a* are spaced 90° apart, whereas recess 51 is 135° from each of the respective recesses 48*a*. In all other respects the angular inclination of the conical surface of the nose portion 38*a*, as well as the depth and wall orientation of the recesses 48*a*, 51 correspond directly with those of the previously described embodiment. The variant recess pattern of the alternate actuator 20*a* has been found to provide a more effective deterrent in that it would be even more difficult to fabricate a tool for unauthorized operation of the actuating nut.

Figure 12:
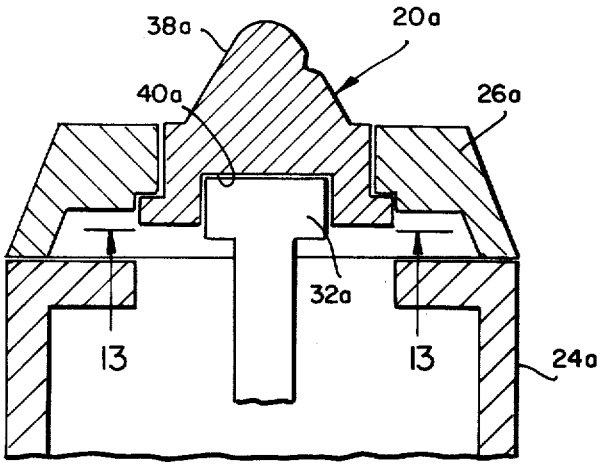
FIG. 12 is a sectional view of another type of hydrant assembly shown the modified valve actuator installed therein.
Figure 7:
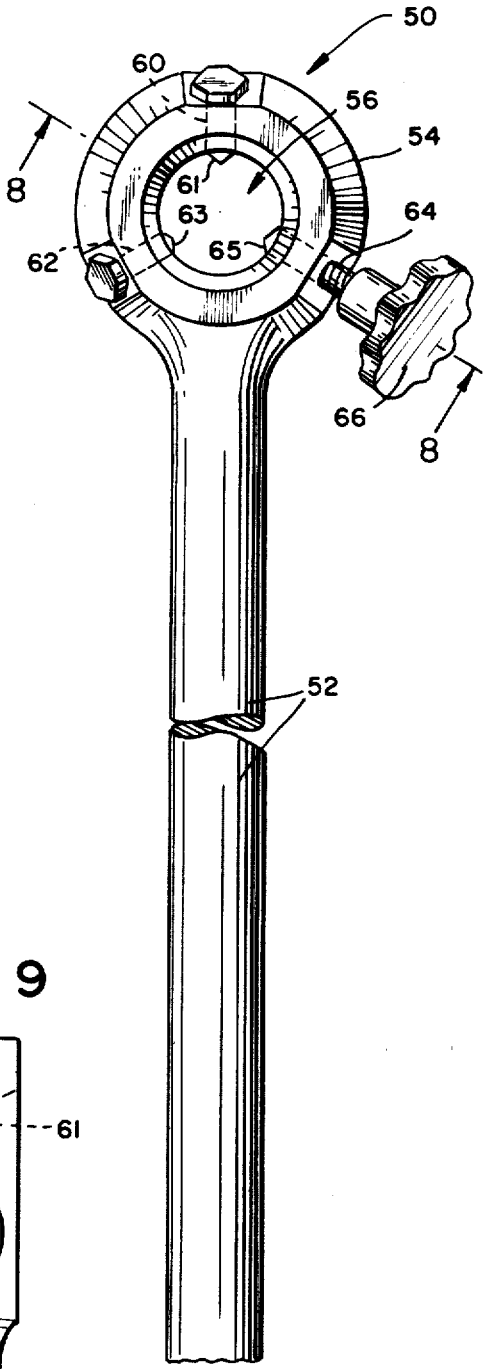
FIG. 7 is a perspective view of the special wrench of this invention adapted for use with the valve actuator illustrating the radially positioned set screws for accommodation within the shallow recesses.

The valve actuator 20*a* is shown in FIG. 12 in a typical installation wherein the bullet shaped nose 38*a* projects above a cap 26*a* mounted above hydrant standpipe 24*a*. The socket 40*a* is coupled to a stem extension 32*a* and is thus adapted to actuate the valve assembly.

The valve actuator 20*a* is adapted to be operated by a companion special wrench (not shown) structurally similar to wrench 50 except that the orientation of the threaded studs or set screws corresponds to the placement of recesses 48*a*, 51 with an adjustble set screw being adapted for engagement with recess 51.

It should further be noted that when the wrench 50 is placed upon the bullet shaped nose 38, the cone points 61, 63, 65 rest upon the conical surface and that a clearance space 70 will provide a visual means for facilitating registration of the annular frame 54 so that the set screws 60, 62, 64 can be readily seated within the recesses 48. A similar clearance space will be evident with regard to the modified embodiment of the actuator 20*a*. It should be also be observed, however, that even without this visible orientation, slight rotation of the wrench within an angular displacement of approximately 60° will usually be sufficient to seat the set screws within the indentations in either embodiment.

It should thus be seen that there is provided a tamper resistant valve actuator which achieves the various objects of the invention and which is well adapted to meet the conditions of practical use.

Since various possible embodiments might be made of the present invention and various changes might be made in the exemplary embodiments as above set forth, it is to be understood that all material set forth or shown and described in the accompanying drawings is to be interpreted as illustrative and not in a limiting sense.

Having thus described the invention, there is claimed as new and desired to be secured by Letters Patent:

1. In a fire hydrant assembly including a hydrant standpipe, a vertically oriented valve stem positioned within said standpipe, said valve stem being rotatable for displacing a valve member and a bonnet enclosing said standpipe and valve stem, wherein the improvement comprises tamper resistant valve actuating means for selectively rotating the valve stem, said actuating means including a body portion extending below said bonnet, coupling means provided in said body portion for engagement with the valve stem and further including a nongrippable conical surface portion projecting through said bonnet, said conical surface defining a bullet shaped nose having a plurality of recesses therein being adapted for cooperative interaction with wrench means for operating said actuating means.

2. A valve actuator as claimed in claim 1 wherein the wrench means includes an annular frame defining a central opening, at least two set screws mounted through said frame and projecting into said central opening, with one of said set screws being variably adjustable.

3. A valve actuator as claimed in claim 2 wherein the wrench means further includes three set screws, each of said set screws having a cone point, with said cone points being accommodatingly receivable in the recesses whereby said variably adjustable set screw can clampingly engage the wrench to the valve actuator.

4. A valve actuator as claimed in claim 3 wherein the frame member has a tapered side wall corresponding to the angular inclination of the conical surface portion of the valve actuator.

5. A valve actuator as claimed in claim 2 wherein the angular inclination of the conical surface portion with respect to a vertical axis is within the range of 15°-35°.

6. A valve actuator as claimed in claim 5 wherein the wrench receiving recess in the conical surface is substantially teardrop shaped having a partial circular perimeter with the noncircular portion defining a curved slip surface converging with the conical surface of the nose, said slip surface corresponding with the direction of rotation for opening said valve.

7. A valve actuator as claimed in claim 6 wherein the wrench receiving recesses lie within a common plane and are equally spaced around the conical surface.

8. A valve actuator as claimed in claim 6 wherein the recesses lie within at least two different planes and are non-uniformly spaced around the conical surface.

9. A valve actuator as claimed in claim 5 wherein the wrench means further includes a pentagon head at its opposite end adapted for use with standard pentagonal nuts.

10. A valve actuator as claimed in claim 7 wherein the depth penetration of the wrench receiving recesses is 5/64" or less.

11. A tamper resistant rotatable actuator in combination with a fire hydrant comprising a cylindrical body member defining a conical surface at one end, said conical surface adapted to project through a housing member for covering a fire hydrant opening, said conical surface further including a plurality of recesses selectively engageable by wrench means for operating said actuator, said recess having a first portion semicircular perimeter wall inclined approximately 60 degrees from a plane normal to the conical surface with the remaining portion of the perimeter wall gradually covering with the conical surface to define a slip surface corresponding with the direction of rotation for substantially eliminating a leverage point by which the actuator could be operated other than with the companion wrench.

12. A tamper resistant actuator as claimed in claim 11 wherein the cylindrical body member includes annular shoulder means cooperatively engaging said housing member for retaining the cylindrical body within said housing member.

13. A tamper resistant actuator as claimed in claim 2 wherein a base portion of said cylindrical body further includes socket means for coupling said actuator to an extension member.

14. A tamper resistant valve actuator as claimed in claim 11 wherein the remaining portion of the perimeter wall of said recess forms an angle in excess of 120 degrees with the first portion of said perimeter wall.

* * * * *